United States Patent [19]

Bloom et al.

[11] Patent Number: 4,621,214

[45] Date of Patent: Nov. 4, 1986

[54] COLOR SELECTION MEANS HAVING A CHARGED INSULATOR PORTION FOR A CATHODE-RAY TUBE

[75] Inventors: Stanley Bloom, Bridgewater; Eric F. Hockings, Princeton, both of N.J.

[73] Assignee: RCA Corporation, Princeton, N.J.

[21] Appl. No.: 602,155

[22] Filed: Apr. 19, 1984

[51] Int. Cl.[4] ..... H01J 29/80

[52] U.S. Cl. ..... 313/402; 313/403; 313/408

[58] Field of Search ..... 313/402, 408, 403

[56] References Cited

U.S. PATENT DOCUMENTS

| | | | |
|---|---|---|---|
| Re. 25,091 | 11/1961 | Ramberg | 315/17 |
| 2,886,730 | 5/1959 | Sheldon | 313/86 |
| 2,908,838 | 10/1959 | Nordberg | 313/85 |
| 2,942,130 | 6/1960 | Sheldon | 313/85 |
| 2,971,117 | 2/1961 | Law | 315/13 |
| 3,688,359 | 9/1972 | Oikawa et al. | 29/25.14 |
| 4,059,781 | 11/1977 | van Alphen et al. | 313/403 |
| 4,066,923 | 1/1978 | van Esdonk | 313/402 |
| 4,107,569 | 8/1978 | Ronde | 313/402 |
| 4,112,563 | 9/1978 | van Esdonk | 29/25.14 |
| 4,128,790 | 12/1978 | Steeghs | 315/382 |
| 4,188,562 | 2/1980 | Van Oostrum | 313/402 |
| 4,427,918 | 1/1984 | Lipp | 313/402 |

FOREIGN PATENT DOCUMENTS 2814391 10/1978 Fed. Rep. of Germany .

*Primary Examiner*—David K. Moore
*Assistant Examiner*—K. Wieder
*Attorney, Agent, or Firm*—Eugene M. Whitacre; Dennis H. Irlbeck; Vincent J. Coughlin, Jr.

[57] ABSTRACT

A cathode-ray tube includes a display screen having an array of phosphor stripes of three different emission colors arranged in cyclic order in adjacent triads. The tube further includes an electron gun for producing three convergent inline electron beams directed toward the display screen. A color selection structure is positioned between the display screen and the electron gun. The color selection structure includes a metal masking plate having therein an array of apertures arranged in columns that are substantially parallel to the phosphor stripes. The color selection structure further includes beam-influencing strips of insulation disposed on the masking plate which, in combination with the masking plate, define an array of windows for transmitting therethrough portions of the electron beams. A high voltage contact is provided for applying a potential to the metal masking plate and to the display screen. The strips of insulation are parallel to the phosphor stripes of the display screen. The strips of insulation are charged to a focusing potential by secondary electrons incident thereon and emanating from the display screen as a result of impingement thereon of the electron beams from the electron gun.

6 Claims, 8 Drawing Figures

COLOR SELECTION MEANS HAVING A CHARGED INSULATOR PORTION FOR A CATHODE-RAY TUBE

BACKGROUND OF THE INVENTION

The invention relates to color selection means for a cathode-ray tube (CRT) and, particularly, to a color selection structure having a metal masking plate with strips of insulation disposed on one surface of the masking plate. A potential is applied to the masking plate, and a focusing potential is developed on the strips of insulation by secondary and reflected primary electrons emanating from a display screen and incident on the insulation.

A conventional shadow-mask-type color television picture tube, which is a CRT, includes generally an evacuated envelope having therein a target comprising an array of phosphor elements of three different emission colors arranged in color groups in cyclic order, means for producing three convergent electron beams directed toward the target, and a color selection structure having an apertured masking plate closely spaced from the target. The masking plate shadows the target, and the differences in convergence angles permit the transmitted portions of each beam to select and excite phosphor elements of the desired emission color.

At about the center of the color-selection structure, the masking plate of a commercial CRT intercepts all but about 18% of the beam currents; that is, the plate is said to have a transmission of about 18%. Thus, the area of the apertures of the plate is about 18% of the area of the masking plate. Since there are no focusing fields present, a corresponding portion of the target is excited by the beamlets of each electron beam.

Several methods have been suggested for increasing the transmission of the masking plate; that is, increasing the area of the apertures relative to the area of the plate, without substantially increasing the excited portions of the target area. In one approach, each of the apertures of the color-selection structure is defined by a quadrupolar electrostatic lens which focuses the beamlets passing through the lens in one transverse direction and defocuses them in the orthogonal transverse direction on the target depending upon the relative magnitudes and polarities of the electrostatic fields comprising the lens.

In one type of quadrupolar-lens color-selection structure described in U.S. Pat. No. 4,059,781 to W. M. van Alphen et al., a strong focusing quadrupolar lens is generated from voltages applied between two sets of substantially-parallel conducting strips, each set being orthogonally positioned with respect to the other, and insulatingly bonded at the intersections of the strips.

In a second approach to increasing the transmission of the masking plate, each aperture in the masking plate is enlarged and split into two adjacent windows by a conductor to form a dipole-quadrupolar lens. The two beamlets passing through the windows of each aperture are deflected around the conductor towards one another, and both beamlets fall on substantially the same area of the target. In this second approach, the transmitted portions of the beams are also focused in one transverse direction and defocused in the orthogonal transverse direction.

One type of dipole-quadrupolar lens color selection structure is described in West German Offenlegungsschrift No. 2,814,391, published Oct. 19, 1978. That publication discloses a CRT having a target, as normally viewed, comprised of a mosaic of vertical phosphor stripes of three different emission colors arranged cyclically in triads (groups of three different stripes), means for producing three convergent horizontally in-line electron beams directed towards the target, and a color selection structure located adjacent the target. The color selection structure comprises a metal masking plate having therein an array of substantially square apertures arranged in vertical columns, and an array of narrow vertical conductors insulatingly spaced from the masking plate, with each conductor substantially centered over the apertures of each of the columns of apertures. Each aperture is also centered over a triad of phosphor stripes. Viewed from the electron-beam-producing means, the conductors divide each aperture into two essentially-equal horizontally-coadjacent windows. This prior art color selection structure has windows with a width-to-height ratio of about 0.46 and transmits about 44% or less of the electron beams.

In any of these and similar structures, it is a major problem to construct an array of conductors that are electrically insulated from one another with the insulation not exposed to the electron beams as is required in a CRT color selection structure. Impingement of the electron beams on exposed portions of the insulation results in localized charging of the insulation and deflection of the electron beams.

U.S. Pat. No. 4,128,790, issued to Steeghs on Dec. 5, 1978, discloses a CRT having a color selection means which utilizes the electron beams to charge one surface thereof to provide a bias voltage. In the Steeghs patent, the color selection means, shown in FIG. 1, comprises an apertured metal plate having vertical conductive strips disposed between the apertures. The conductive strips are insulated from the metal plate by means of insulating material, for example, a glass layer about 0.06 mm thick. The conductive strips consist of vapor-deposited aluminum about 0.0005 mm thick overlying the glass layer. The conductive strips are mutually interconnected but otherwise insulated from the metal plate. During operation of the tube, a voltage of 25 kV is applied to the metal plate and to the display screen of the tube. The electron beams from the electron guns are partially intercepted by the conductive strips of the color selection means which become negatively charged to a suitable bias voltage. In this tube structure, the metal plate of the color selection means is adjacent to the display screen, and the insulative glass layer and the conductive strips are formed on the side of the metal plate facing the electron gun. The bias potential on the conductive strips is controlled by a voltage stabilization rectifier comprising a series arrangement of twenty Zener diodes, each having a Zener voltage of 75 volts, so that the overall Zener voltage is 1.5 kV. The Zener diodes limit the voltage difference of the color selection means because of the conduction of the diodes, and the impinging electron beams prevent the voltage difference from decreasing because of the negative charge imparted to the conductive strips.

The color selection structure described in the Steeghs patent is complex and expensive to manufacture. The electrical reliability of the structure depends on the electrical integrity of the twenty Zener diodes and on the integrity of the aluminum film strips vapor deposited on the glass layer. Electrical breakdown at one point along the strips would result in complete collapse of the bias voltage. Thus, the need exists for a simple, inexpensive and reliable color selection structure.

SUMMARY OF THE INVENTION

A cathode-ray tube includes a display screen having an array of phosphor stripes of a plurality of different emission colors arranged in cyclic order in adjacent groups. The tube further includes means for producing a plurality of convergent electron beams directed toward the display screen. Color selection means is positioned between the display screen and the beam-producing means. The color selection means includes a metal masking plate having therein an array of apertures arranged in columns that are substantially parallel to the phosphor stripes. The color selection means further includes beam-influencing means disposed on the metal masking plate which, in combination with the metal masking plate, defines an array of windows for transmitting therethrough portions of the electron beams. Means are provided for applying a potential to the metal masking plate and to the display screen. The beam-influencing means comprises strips of insulation disposed on one side of the metal masking plate facing the display screen parallel to the phosphor stripes. The strips of insulation are charged to a focusing potential by secondary electrons incident thereon and emanating from the display screen as a result of impingement thereon of the electron beams from the beam-producing means.

DETAILED DESCRIPTION OF THE PREFERRED EMBODIMENTS

Figure 1:
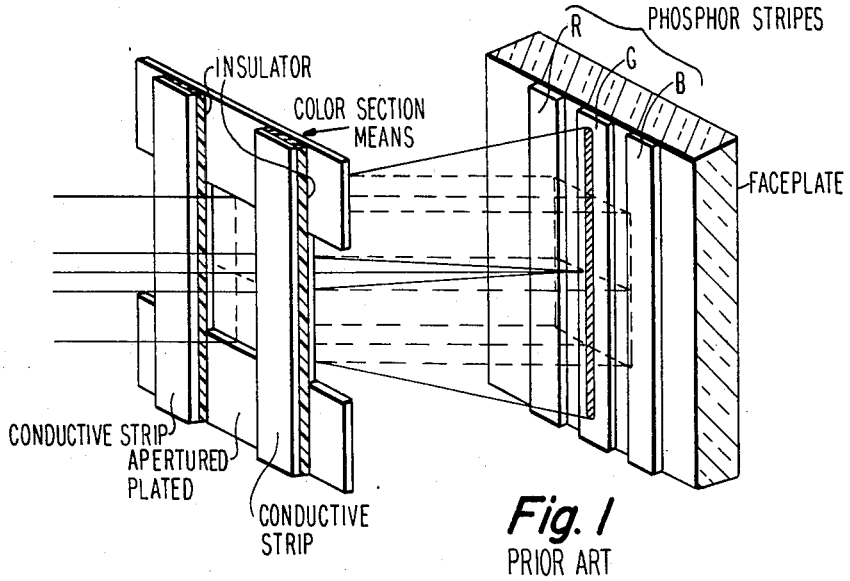
Fig. 1 PRIOR ART
FIG. 1 is a perspective view of a portion of a prior art color selection means and display screen.
Figure 2:
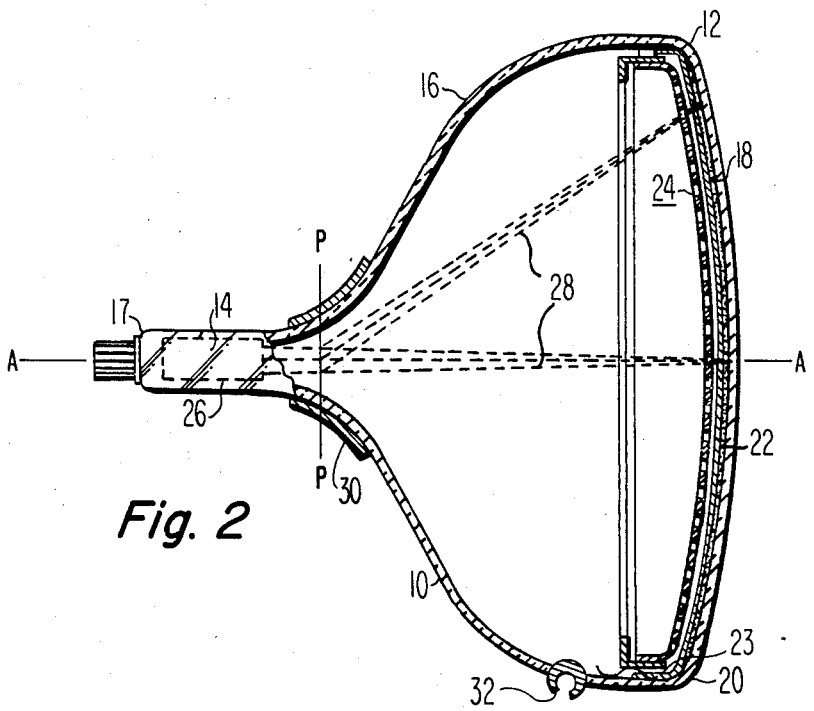
FIG. 2 is a plan view, partially in axial section, of a cathode-ray tube (CRT) in which the present invention is utilized.

FIG. 2 is a plan view of a rectangular cathode-ray tube, e.g., a color picture tube, having a glass envelope 10 comprising a rectangular faceplate panel or cap 12 and a tubular neck 14 connected by a rectangular funnel 16. A stem 17, having a plurality of leads or pins (not shown), closes the end of the neck 14. The panel 12 comprises a viewing faceplate 18 and a peripheral flange or sidewall 20 which is sealed to the funnel 16. A phosphor display screen 22 is carried by the inner surface of the faceplate 18. The display screen is preferably a line screen with an array of three different emission color stripes arranged in cyclic order in adjacent groups or triads extending substantially perpendicular to the high frequency raster line scan of the tube (normal to the plane of FIG. 2). A film 23 of a light-reflecting material covers the screen 22 is a manner known in the art. An improved color selection structure 24 is removably mounted, by conventional means, in predetermined spaced relation to the screen 22. An inline electron gun 26, shown schematically by dotted lines in FIG. 2, is centrally mounted on the longitudinal axis A—A within the neck 14 to generate and direct three electron beams 28 along coplanar convergent paths through the color selection structure 24 to the screen 22.

The tube of FIG. 2 is designed to be used with an external magnetic deflection yoke, such as the self-converging yoke 30 schematically shown surrounding the neck 14 and funnel 16 in the neighborhood of their junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 2 at about the middle of the yoke 30.

Operating potentials for the tube are provided through the pins of stem 17 and through a high voltage contact 32 located in the funnel 16 of the envelope 10.

Figure 3:
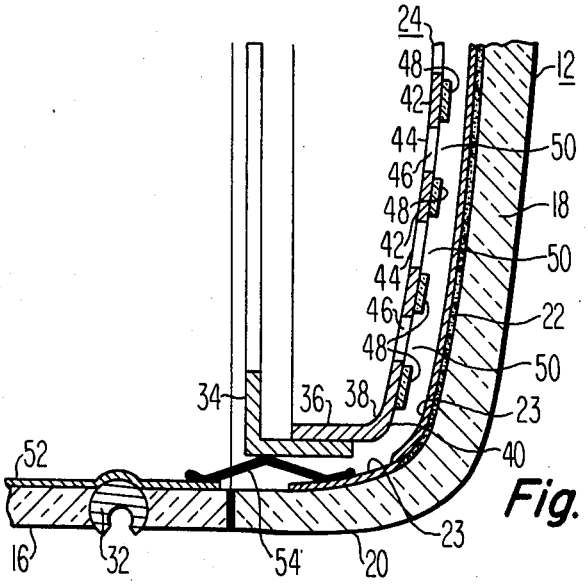
FIG. 3 is a fragmentary view of the tube of FIG. 2 showing one embodiment of the novel color selection structure of the present invention.
Figure 4:
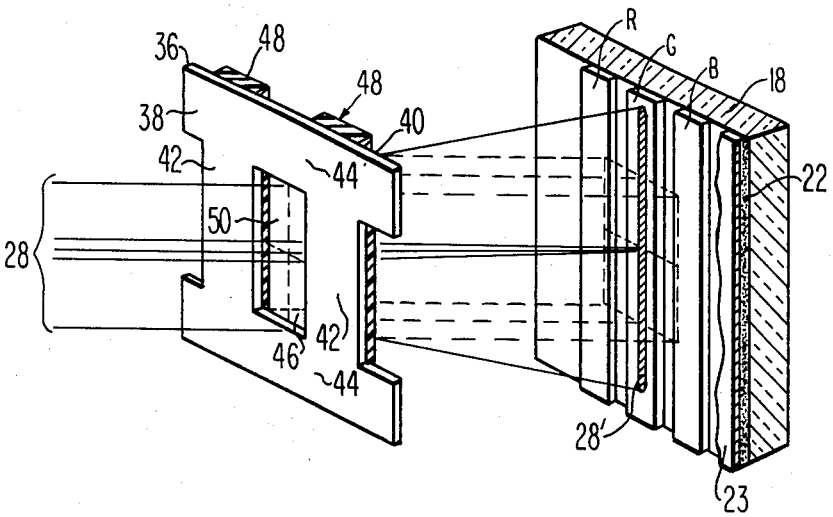
FIG. 4 is a perspective view of a portion of the novel color selection structure and display screen.

The details of one embodiment of the improved color selection structure 24 are shown in FIG. 3. The color selection structure 24 comprises an L-shaped support frame 34 and a metal masking plate 36 which is attached thereto. The metal masking plate 36, shown in FIGS. 3 and 4, is transversely disposed across the longitudinal axis A—A between the display screen 22 and the electron gun 26 (shown in FIG. 2). The masking plate 36 has a first surface 38 and a second surface 40. The first surface 38 of the masking plate 36 faces the electron gun. The masking plate 36 includes an array of vertical webs 42 and horizontal webs 44 which define an array of apertures 46 arranged in columns that are substantially parallel to phosphor stripes R, G, B (shown in FIG. 4). Each of the vertical webs 42 of the masking plate 36 has a beam-influencing means comprising a strip 48 of insulation disposed on the second surface 40 thereof, facing the display screen 22. The strips 48 of insulation are arranged parallel to the vertical webs 42 of the masking plate 36 and to the phosphor stripes of the display screen 22. The strips 48 of insulation disposed on the vertical webs 42 of the masking plate 36 act in combination with the masking plate to define an array of windows 50 for transmitting therethrough portions of the electron beams 28 (shown in FIG. 4).

In the preferred embodiment, the vertical webs 42 of the masking plate 36 have a width of about 0.15 mm (6 mils), and the horizontal webs 44 have a width of about 0.08 mm (3 mils). The vertical height of each of the apertures 46 is about 0.74 mm (29 mils), and the width of each aperture is about 0.61 mm (24 mils). The width of each of the strips 48 of insulation is about 0.13 mm (5 mils). The thickness of each of the strips 48 is about 0.025 mm (1 mil).

In the operation of the tube, an ultor voltage ranging from about 10 kV to about 25 kV is applied to terminal 32, and appropriate voltages are applied to the electron gun 26 through the leads of stem 17. As shown in FIG. 3, an internal conductive coating 52 is disposed on the internal surface of the funnel 16 and in contact with the terminal 32. A spring contact 54 extends between the conductive coating 52 and the film 23 on the display screen 22. The contact 54 is configured to also provide an electrical connection to the color selection structure 24. Thus, ultor voltage is provided to the electron gun in a manner known in the art and to the color selection structure 24 and to the display screen 22. The electron beams from the electron gun 26 are directed toward the display screen 22 in a plane that is substantially normal to the stripes R, G, B of the screen 22. The electron beams pass through the windows 50 and impinge upon the display screen 22, causing the phosphors to emit. In addition, secondary electrons are created by the impact of the electron beams on the screen 22, and the secondary electrons emanating from the screen 22 are incident on the strips 48 of insulation disposed on the second surface 40 of the masking plate 36.

The secondary electrons from the screen 22 charge the strips 48 of insulation with a total charge that is dependent on the width of the insulator strips 48. The wider the strips 48, the greater the amount of equilibrium charge residing on the insulation. The effective potential of the insulating strip 48 at equilibrium is determined by the rate of deposition of charge and the rate of leakage of charge to the masking plate 36. In the color selection structure 24 of FIGS. 3 and 4, a quadrupolar lens is created. The masking plate 36 operates at ultor potential, $V_o$, while the strips 48 of insulation charge, by secondary electron emission from the screen 22, to a another voltage, $V_o-\Delta V$, which is more negative than the ultor voltage, $V_o$, by an amount equal to the bias potential, $\Delta V$. Thus, the more negative strips 48 of insulation tend to focus the electron beams in one transverse direction and defocus the electron beams in the orthogonal transverse direction. Since the strips 48 of insulation extend parallel to the phosphor stripes of the display screen 22, the focusing occurs in the transverse direction of the phosphor stripes to provide color fidelity. The defocusing in the longitudinal direction of the phosphor stripes does not degrade the performance of the tube. The focused beam 28' is shown in FIG. 4.

The above-described color selection structure 24 requires only a single applied electrical potential for its operation. The second potential is provided by the secondary emission charging of the strips 48 of insulation. The structure 24 thus eliminates the need for a second electrode attached to the insulators and a second applied electrical potential to bias the second electrode. By using secondary emission to charge the strips 48 of insulators, rather than directly charging a second electrode in the manner disclosed in the Steeghs patent, referenced above, the voltage stabilization rectifier comprising a plurality of Zener diodes is not required, thereby increasing the simplicity and reliability of the present color selection structure 24 without increasing its cost.

Although previously described two-electrode color selection structure known in the art have usually used polyimides as insulators, the choice of insulators in the present color selection structure 24 is not so limited, and a greater variety of cathode-ray tube compatible materials, including dielectrics, semiconductors and cermets, may be used. Indeed, the wider choice of surface and bulk resistivities provides another means for tailoring the values of equilibrium charge and potential of the insulator strips 48.

Figure 5:
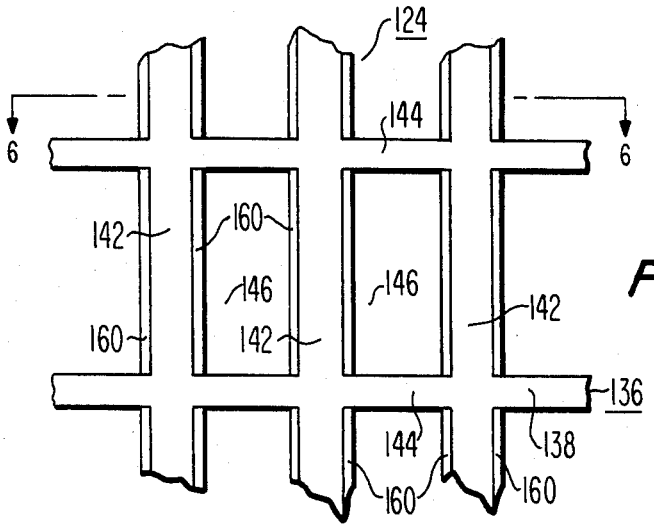
FIG. 5 is a plan view of a fragment of a second embodiment of the present invention.
Figure 6:
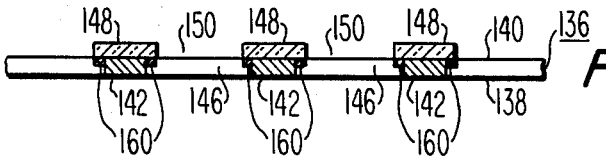
FIG. 6 is a top view taken along line 6—6 of FIG. 5.

A second embodiment of a color selection structure 124 is shown in FIGS. 5 and 6. The color selection structure 124 is a quadrupolar lens structure similar to the structure 24 described with reference to FIGS. 3 and 4. The color selection structure 124 includes a support frame (not shown) and a metal masking plate 136. The metal masking plate 136 has a first surface 138 and a second surface 140. The first surface 138 faces the electron gun (not shown), and the second surface faces the display screen (not shown). The masking plate 136 includes an array of vertical webs 142 and horizontal webs 144 which define an array of apertures 146. Each of the vertical webs 142 of the masking plate 136 has a beam-influencing strip 148 of insulation disposed on the second surface 140 facing the display screen. The insulator strips 148 are arranged parallel to the phosphor stripes of the display screen (not shown). The insulator strips 148, in combination with the masking plate 136, define an array of windows 150 for transmitting therethrough portions of the electron beams.

In this second embodiment, the masking plate 136 has the same dimensions as the masking plate 36 previously described. The strips 148 of insulation are wider than the corresponding strips 48 so that they extend beyond the edges of the vertical webs 142 of the masking plate 136 for a distance of about 0.025 mm (1 mil) on either side. The greater width of the insulator strips 148 permits a greater equilibrium potential charge to accumulate on the strips. To prevent direct charging by the impingement of the electron beams from the electron gun, a thin layer 160 of conductive material, e.g., aluminum, is vapor deposited on the electron gun-facing portions of the insulator strips 148 extending beyond the vertical webs 142 of the masking plate 136. The layer 160 is typically about 2000 Å thick.

The insulator strips 148 typically have a width of about 0.2 mm (8 mils). The vertical height of each of the apertures 146 is about 0.74 mm (29 mils), and the width is about 0.56 (22 mils). The thickness of each of the insulator strips 148 is about 0.025 mm (1 mil). The color selection structure 124 operates in the same manner as color selection structure 24, previously described.

Figure 7:
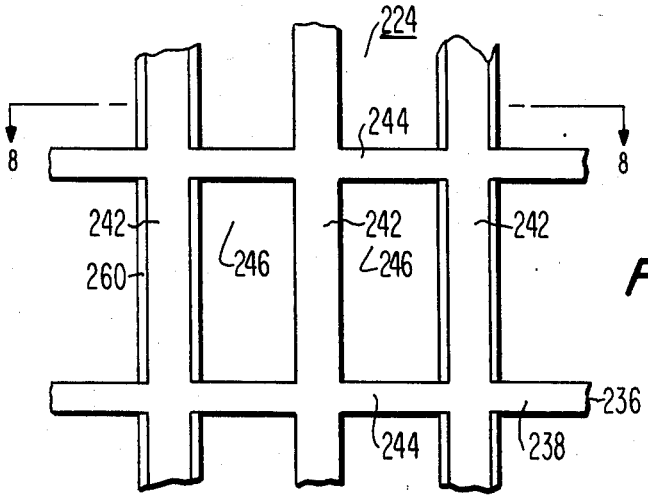
FIG. 7 is a plan view of a fragment of a third embodiment of the present invention.
Figure 8:
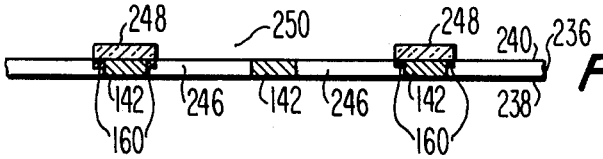
FIG. 8 is a top view taken along line 8—8 of FIG. 7.

A dipole-quadrupole lens color selection structure 224 is shown in FIGS. 7 and 8. The color selection structure 224 includes a support frame (not shown) and a metal masking plate 236. The metal masking plate 236 has a first surface 238 facing the electron gun (not shown) and a second surface 240 facing the display screen (not shown). The masking plate 236 includes an array of vertical webs 242 and horizontal webs 244 which define an array of apertures 246. Selected ones of the vertical webs 242 have a beam-influencing strip 248 of insulation disposed on the second surface 240 facing the display screen. As shown in FIGS. 7 and 8, the insulator strips 248 are disposed on every other vertical web 242 of the masking plate 236. The vertical web 242 of the masking plate 236, which does not have an insulator strip thereon, thus acts as a conductor which divides the aperture 246 into two equal portions in the manner disclosed in the above-referenced Offenlegungsschrift No. 2,814,391. Two adjacent apertures 246 separated by a vertical web 242 without an insulator strip thereon define a window 250. While the insulator strips 248 are shown to extend beyond the edges of the vertical webs 242 and to be coated on the electron gun-facing surface with a layer 260 of conductive material such as vapor deposited aluminum, it is within the scope of the invention to provide insulator strips that are narrower than the vertical webs 242 of the masking plate 236.

In the color selection structure 224 shown in FIGS. 7 and 8, ultor potential, $V_o$, is applied to the metal masking plate 236 and to the display screen (not shown). The insulator strips 248 are charged to an equilibrium potential by secondary electrons emanating from the display screen as a result of the impingement thereon of the electron beams from the electron gun (not shown). A voltage $V_o-\Delta V$, which is more negative than the ultor potential by an amount equal to the bias potential, $\Delta V$, is impressed on the insulator strips 248. In the dipole-quadrupolar lens color selection structure 224, the two portions of the window 246 combine to span one triad of phosphor stripes on the display screen (not shown), as described in the above-referenced Offenlegungsschrift No. 2,814,391. The negative bias voltage on the insulators 248 focuses the portions of the electron beam which pass through the window 250 comprising both portions of the apertures 246 toward the positively charged vertical web 242 and onto one of the phosphor stripes. The color produced depends on the angle of the incident electron beam, as is known in the art.

What is claimed is:

1. In a cathode-ray tube including a display screen comprising an array of phosphor stripes of a plurality of different emission colors arranged in cyclic order in adjacent groups, means for producing a plurality of convergent electron beams directed toward said display screen, color selection means positioned between said display screen and said beam-producing means, said color selection means including a metal masking plate having therein an array of apertures arranged in columns that are substantially parallel to said phosphor stripes, and beam-influencing means disposed on said metal masking plate which in combination with said metal masking plate define an array of windows for transmitting therethrough portions of said electron beams, and means for applying a potential to said metal masking plate and said display screen, the improvement wherein said beam-influencing means comprising strips of insulation disposed between the aperture columns on the side of said metal masking plate facing said display screen, said strips of insulation being arranged parallel to said phosphor stripes, said strips of insulation being charged to a focusing potential by secondary electrons incident thereon, said secondary electrons emanating from said display screen as a result of the impingement thereon of said electron beams.

2. In a color picture tube including a display screen comprising an array of substantially parallel phosphor stripes of three different emission colors arranged in cyclic order in adjacent triads, each triad comprising a stripe of each of said three different emission colors, means for producing three convergent inline electron beams directed toward said display screen in a plane that is substantially normal to said stripes, a color selection structure positioned between said display screen and said beam-producing means, said color selection structure including a metal masking plate having a first surface and a second surface, said masking plate comprising an array of vertical webs and horizontal webs defining apertures arranged in columns that are substantially parallel to said phosphor stripes, and beam-influencing means disposed on said metal masking plate which in combination with said metal masking plate defines an array of windows for transmitting therethrough portions of said electron beams, and means for applying a potential to said metal masking plate and to said display screen, the improvement wherein said metal masking plate is disposed so that said first surface faces said beam-producing means, and said beam-influencing means comprising strips of insulation selectively disposed on said second surface of said masking plate facing said display screen, said strips of insulation being arranged parallel to said vertical webs of said masking plate and to said phosphor stripes, said strips of insulation being charged to a focusing potential by secondary electrons incident thereon, said secondary electrons emanating from said display screen as a result of the impingement thereon of said electron beams.

3. The picture tube defined in claim 2, wherein said strips of insulation are narrower than said vertical webs of said masking plate.

4. The picture tube defined in claim 2, wherein said strips of insulation are wider than said vertical webs of said masking plate, the portions of said strips of insulation extending beyond said vertical webs of said masking plate and facing said beam-producing means having a conductive material disposed thereon to prevent direct charging of said strips of insulation by said electron beams.

5. The picture tube defined in claim 2, wherein said strips of insulation are disposed on every vertical web of said masking plate to provide a quadrupole focusing structure.

6. The picture tube defined in claim 2, wherein said strips of insulation are disposed on alternate vertical webs to provide a dipole-quadrupole focusing structure.

* * * * *